United States Patent [19]

O'Rourke

[11] Patent Number: 4,469,377

[45] Date of Patent: Sep. 4, 1984

[54] PATIENT-RESTRAINING STRAPLESS SEAT

[76] Inventor: Mary M. O'Rourke, 7949 Lowry Ter., La Jolla, Calif. 92037

[21] Appl. No.: 335,069

[22] Filed: Dec. 28, 1981

[51] Int. Cl.[3] ..... A47C 31/00

[52] U.S. Cl. ..... 297/464; 297/441; 297/457; 297/DIG. 2

[58] Field of Search ..... 297/DIG. 2, 216, 441, 297/457, 464, 310

[56] References Cited

U.S. PATENT DOCUMENTS

| | | | |
|---|---|---|---|
| 2,591,911 | 4/1962 | Block | 297/464 X |
| 3,195,954 | 7/1965 | Moreno | 297/441 X |
| 3,645,548 | 2/1972 | Briner | 297/216 |
| 3,695,702 | 10/1972 | Ingellis | 397/441 |
| 3,870,364 | 3/1975 | Cortino | 297/310 |
| 4,049,314 | 9/1977 | McCoffin | 397/441 X |
| 4,222,740 | 10/1980 | East | 297/310 |
| 4,230,364 | 10/1980 | Parker | 297/441 |

*Primary Examiner*—James T. McCall
*Attorney, Agent, or Firm*—Roy L. Knox

[57] ABSTRACT

A seat, which may be chair-like, for patients who must be restrained against leaving the seat, the principal feature being an elongated flexible seat element hung like a hammock but without a swinging function, the buttocks-receiving portion being much lower than the knees-supporting portion so that the patient once seated cannot unassisted pull himself forwardly, while the seat frame prevents escape laterally. There are no straps, bands or other obvious restraining means and virtually no chance of injury to the patient.

2 Claims, 2 Drawing Figures

PATIENT-RESTRAINING STRAPLESS SEAT

BACKGROUND OF THE INVENTION

The care of geriatric, psychotic or disturbed persons frequently requires physical restraint to prevent injury, this being true in institutional care centers as well as in private homes. Such restraint at night is regularly accomplished by strapping the patient in bed without great trauma but many patients resent restraint particularly during the day when they are strapped in chairs. This resentment and frequently accompanying strenuous efforts to circumvent the restraining means may itself cause psychological impairment and/or physical injury. There is a need, therefore, for a daytime chair-like seat for individual use by such a patient, that is, a seat which will comfortably accommodate yet restrain the patient from escape from the chair without resort to hated straps, bars and like restraining devices.

SUMMARY OF THE INVENTION

This invention as claimed is a satisfactory response to the immediately abovementioned need, being a seat for one such patient, comfortable and devoid of apparent restraining straps or like patient-restraining means. The seat has an open frame which supports a hammock-like unit of strong flexible material upon which the patient is seated with the knees considerably higher than the buttocks. This is a comfortable position for many patients for a reasonable period of time and a welcome change from a prone position in a bed, yet the patient cannot pull himself or herself out of this position even though considerable freedom to flex the body and arms for desirable exercise is retained. The frame has side members of panel or bar form disposed generally bilaterally, at least of the buttocks-supporting portion of the frame which limit sidewise movement, and where desirable the frame, can include anti-tilt means notably at the rear of the frame to prevent a patient-occupant of the chair from tilting the entire seat assembly backward.

DETAILED DESCRIPTION OF THE INVENTION

Figure 1:
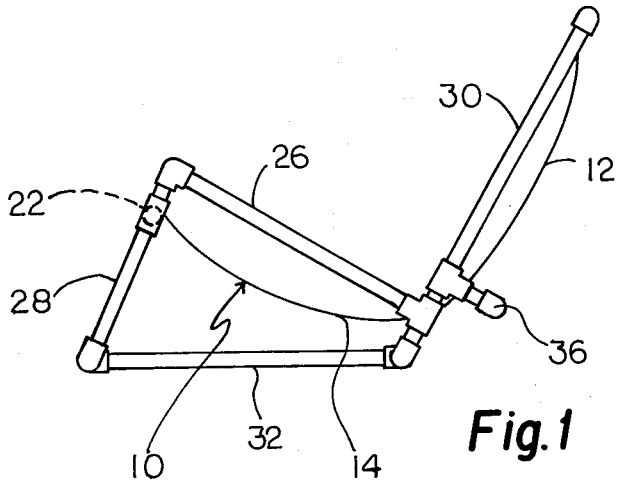
FIG. 1 is a side elevational view of the patient-restraining seat relied upon particularly to show substantially the relative positioning of the knees-supporting portion and the buttocks-supporting portion when the seat is in use.

A preferred embodiment of the invention, a form which has been manufactured and tested in use with women and men patients with outstanding success, is illustrated in the drawings. The flexible hammock-like seat element, generally indicated by the numeral 10, is preferably of one piece construction and must of course have high tensile strength to support the weight of a patient. Canvas and nylon open-mesh net material are suitable materials.

Figure 3:
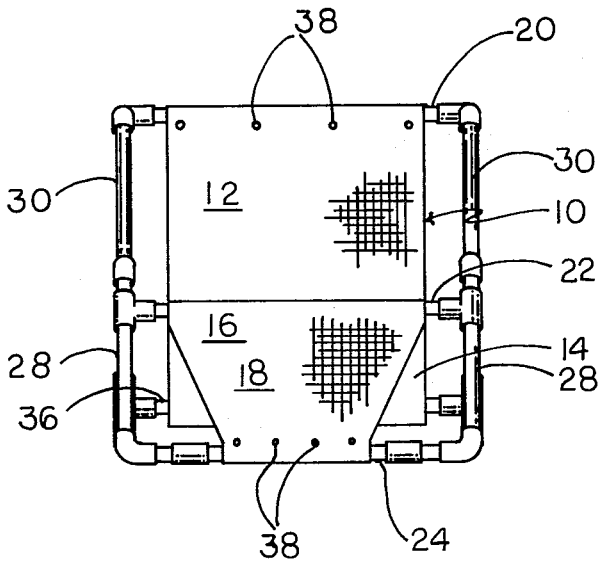
FIG. 3 is front elevational view of the seat.

The flexible seat element 10, although preferably unitary, can advantageously be regarded as having three principal functional portions, namely, the back-supporting portion 12, the buttocks-supporting portion 14 as shown in the drawing very close to the bottom of the seat assembly which will be understood as resting on a floor, the knees-supporting portion 16 which support the knees at knee-height and, if preferred, a front flap 18. It is critically important that the portion 14 shall be much lower than the portion 16. The back-supporting portion has the upper terminal thereof secured to the top back crossbar 20 of a rigid seat frame and a knees-supporting portion preferably draped over a crossbar 22, shown best in FIG. 3. The flexible seat element may terminate and be attached to the crossbar 22 or as shown may be draped thereover to extend downwardly as the abovementioned flap 18 for attachment to a lower front frame crossbar 24.

The rigid frame has been mentioned as including the crossbars 20, 22 and 24, the simple term crossbar denoting any horizontal structure capable of fixedly and strongly supporting the corresponding portion of the flexible seat element and said structure, augmented possibly by frame side members 26, representing the essential structure of said frame. However, it is preferred that the frame be chair-like as illustrated, easily portable and capable of economical manufacture and to this end the crossmembers 20, 22, 24 and the side members 26 are tubular, ordinarly plastic, or alumninum for lightness, and all the other portions of the frame are similar thereto.

Figure 2:
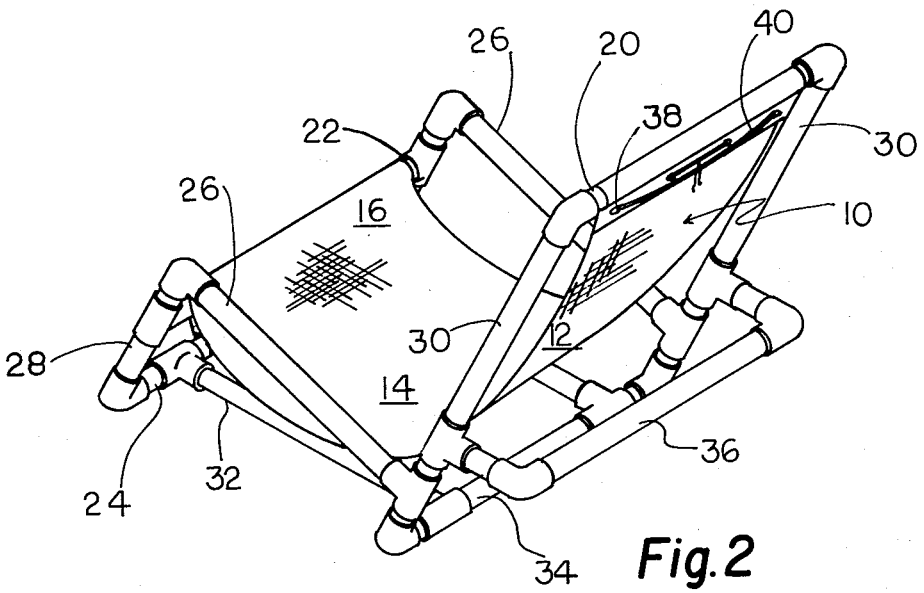
FIG. 2 is an isometric, slightly enlarged view of the seat turned through an angle of approximately 45°.

The front legs structure includes sharply rearwardly upwardly inclined leg elements 28 as well as the aforementioned crossmember 22 and 24. The rear legs structure includes similarly sharply rearwardly inclined leg elements 30 much longer than the front leg elements, so that the aforementioned crossmember 20 is much higher than the crossmember 22 and disposed as shown in FIG. 2 considerably rearwardly from the bottom of the rear legs structure for proper elevation and sharply rearward orientation of the back-supporting portion 12. A pair of back-to-front stringers 32 connect the front crossmembers 24 with a rear crossmember 34 of the rear legs structure. The side members 26 and the back-to-front stringers 32 together maintain the front and rear legs structures substantially parallel and rearwardly upwardly inclined. Finally, in regard to the structure of the rigid chair-like frame, an anti-tilt member 36, again in the form of a crossbar, is secured across the rear of the rear legs structure, being secured to and between the rear leg elements 30.

The function and operation of the invention as related in the foregoing Summary and in the claims below is the provision of a comfortable seat for geriatric, psychotic or disturbed persons requiring restraint. Such patients when once seated in the abovedescribed seat cannot escape therefrom unassisted because of the critical positioning of the buttocks-supporting portion 14 much below the level of the knees-supporting portion 16. The frame side members illustrated at 26 help to define a cubicle for the patient inasmuch as the side members 26 prevent the patient from wiggling laterally out of the seat. The flexible seat element 10 can be provided with grommets at the lower and upper terminals thereof as indicated at 38 and tied as indicated at 40 to the crossbars 20 and 24, or any suitable fastening means may be employed, it being desirable that any such fastening means should be difficult for the patient to reach when seated in the seat, while providing for easy removal and replacement of the flexible seat element 10.

What I claim as new and desire to protect by Letters Patent, is:

1. A patient-restraining strapless seat, comprising: a frame adapted to rest on a floor, said frame having upwardly rearwardly inclined front legs structure, and rear legs and back structure; an elongated hammock-like flexible element slung within said frame and having a knees-supporting portion supported at knee height by said front legs structure, a patient's back-supporting portion secured to an upper part of said rear legs and back structure, and a buttocks-supporting portion (14) intermediate the other said portions at a level much below the level of the knees-supporting portion and close to the floor so that a patient may be seated thereon with the buttocks very close to the floor and the knees at knee height and be restrained from escaping unassisted from the seat; said rear legs and back structure being upwardly rearwardly sharply inclined to dispose said patient's back- supporting portion of the hammock-like element well to the rear of said buttocks-supporting portion, and said frame having members disposed bilaterally of a least said buttocks-supporting portion for the patient's comfort and for further insuring restraint from escape.

2. A seat according to claim 1 wherein said front legs structure has a crossmember closely adjacent to the top thereof said rear legs structure has a crossmember adjacent to the top thereof and much higher than the first mentioned crossmember and said hammock-like member is slung between said crossmembers; and a third crossmember parallel to the other said crossmembers adjacent the lower end of said front legs structure; said hammock-like element being draped over the first mentioned crossmember as a depending flap (18) terminally secured to said third crossmember.

* * * * *